United States Patent [19]

Kulczycki et al.

[11] 4,013,103

[45] Mar. 22, 1977

[54] TRIAXIAL WEAVING MACHINE WITH HEDDLE TRANSFER AND METHOD

[75] Inventors: Karol Kulczycki, Parsippany, N.J.; Burns Darsie, Rockford, Ill.

[73] Assignee: Barber-Colman Company, Rockford, Ill.

[22] Filed: Aug. 11, 1975

[21] Appl. No.: 603,756

[52] U.S. Cl. ..... 139/11; 139/DIG. 1; 139/48

[51] Int. Cl.[2] ..... D03C 13/00

[58] Field of Search ..... 139/1, DIG. 1, 11, 35, 139/48, 49, 50, 55; 66/66, 69, 85

[56] References Cited

UNITED STATES PATENTS

| | | | |
|---|---|---|---|
| 550,068 | 11/1895 | Crompton | 139/11 |
| 1,368,215 | 2/1921 | Stewart | 139/DIG. 1 |
| 1,752,804 | 4/1930 | Nicolet | 139/11 |

FOREIGN PATENTS OR APPLICATIONS

| | | | |
|---|---|---|---|
| 484,092 | 8/1953 | Italy | 139/11 |

*Primary Examiner*—Henry S. Jaudon

[57] ABSTRACT

A weaving machine and method for making triaxial fabrics in which a plurality of elongate heddles are arranged in weftwise rows for guiding respective warp strands, for forming the warp strands into warp sheds through which wefts are inserted, and for shifting the warp strands weftwise. In accordance with this invention, heddles are engagingly received at one end of one row and are transferred to an adjacent end of another row. Preferably, transferring of heddles involves pivotal movement thereof in particular relationship to other instrumentalities of the weaving machine.

31 Claims, 15 Drawing Figures

TRIAXIAL WEAVING MACHINE WITH HEDDLE TRANSFER AND METHOD

This invention relates to weaving machines and methods for making triaxial fabrics in which wrap strands are guided by heddles and heddles are transferred from the end of one weftwise row to the adjacent end of another weftwise row. More particularly, this invention relates to triaxial weaving machines and methods which are improvements over prior proposals such as are found in Stewart U.S. Pat. No. 1,368,215 and Crompton U.S. Pat. No. 550,068, in that heddles are engagingly received at one end of one row and are transferred to an adjacent end of another row. By the provision of such heddles and transfer means in accordance with this invention as hereinafter described, control over positioning of warp strands into warp sheds for insertion of wefts and shifting of the warp strands weftwise into triaxial relationships are accomplished while heavy and cumbersome mechanisms are avoided. Further, imposition of undue stress on the warp strands or the mechanisms of the weaving machine is avoided during transfer of heddles to accommodate weftwise shifting.

It is an object of this invention to provide means for engagingly receiving a heddle and for moving an engagingly received heddle from one end of one weftwise row of heddles to the adjacent end of another weftwise row. In accomplishing this object, a triaxial weaving machine having a plurality of heddles arranged in weftwise rows for guidingly receiving a plurality of warp strands, a shedding motion for moving the heddles longitudinally and forming the warp strands into warp sheds, a weft inserter for inserting wefts into warp sheds so formed and a shifting motion for moving the heddles weftwise is accommodated to smooth mechanical operation while undesirable stress and strain are avoided.

A further object of this invention is the transfer of heddles from one end of one of a pair of substantially opposing rows of heddles to an adjacent end of the other row of the same pair by moving the heddle along a particular path and in a particular manner. In realizing this object, displacements of warp strands which would subject the strands to undesirable tensioning are avoided.

It is yet a further object of this invention to provide, in a triaxial weaving machine having passageways for guiding individual and separately movable heddles which are arranged in rows, a heddle transfer mechanism which engagingly receives a heddle from an endmost passageway at one end of one row of heddles and moves the heddle into cooperating relation with an endmost passageway at an adjacent end of another row of heddles.

Some of the objects of the invention having been stated, other objects will appear as the description proceeds when taken in connection with the accompanying drawings, in which.

Figure 1:
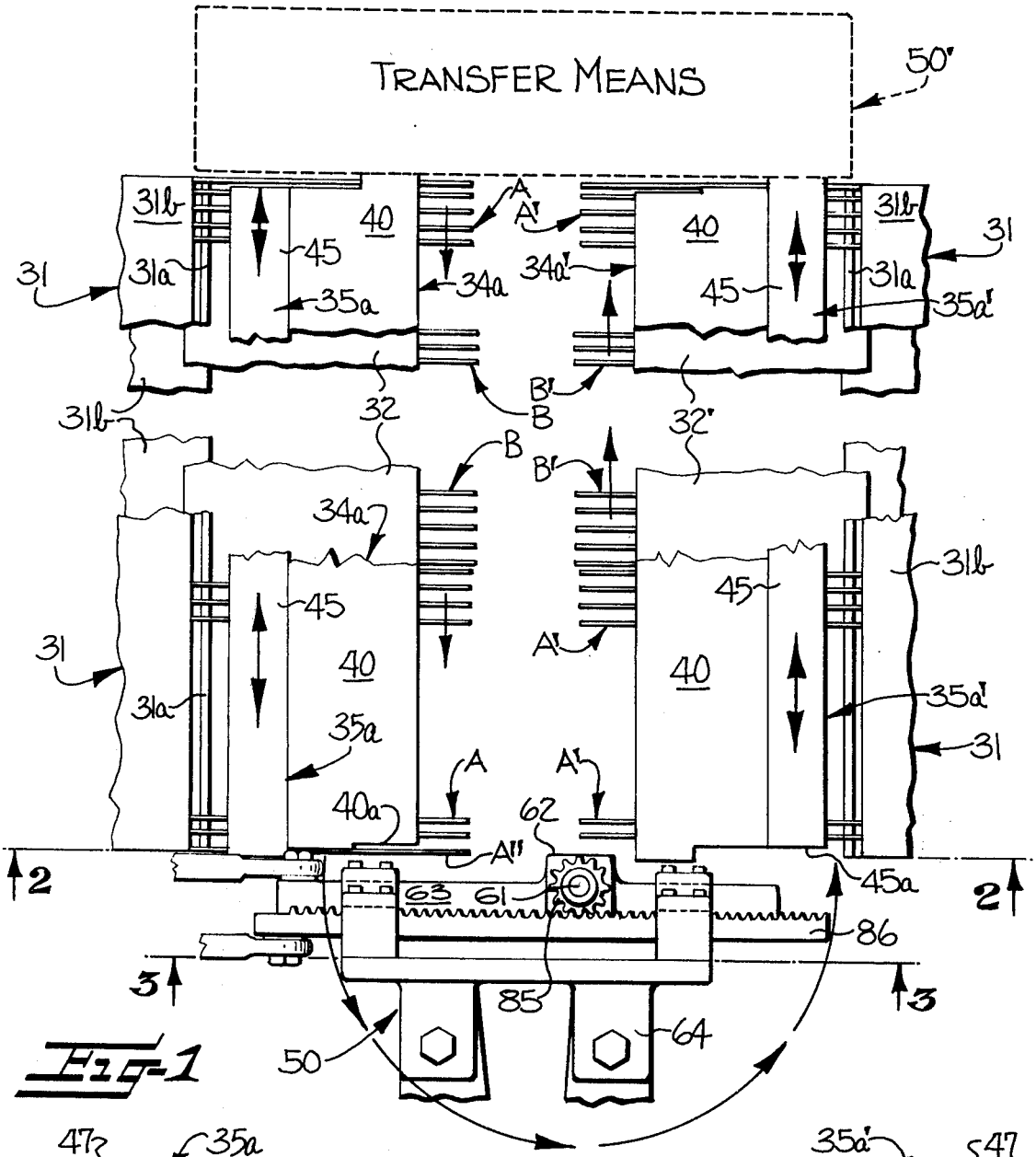
FIG. 1 is a schematic top plan view of a preferred arrangement of the shed forming instrumentalities of the improved triaxial weaving machine, particularly illustrating the improved heddle transfer means adjacent opposite weftwise ends of the shed forming instrumentalities.
Figures 3, 4, 5, 6, 7:
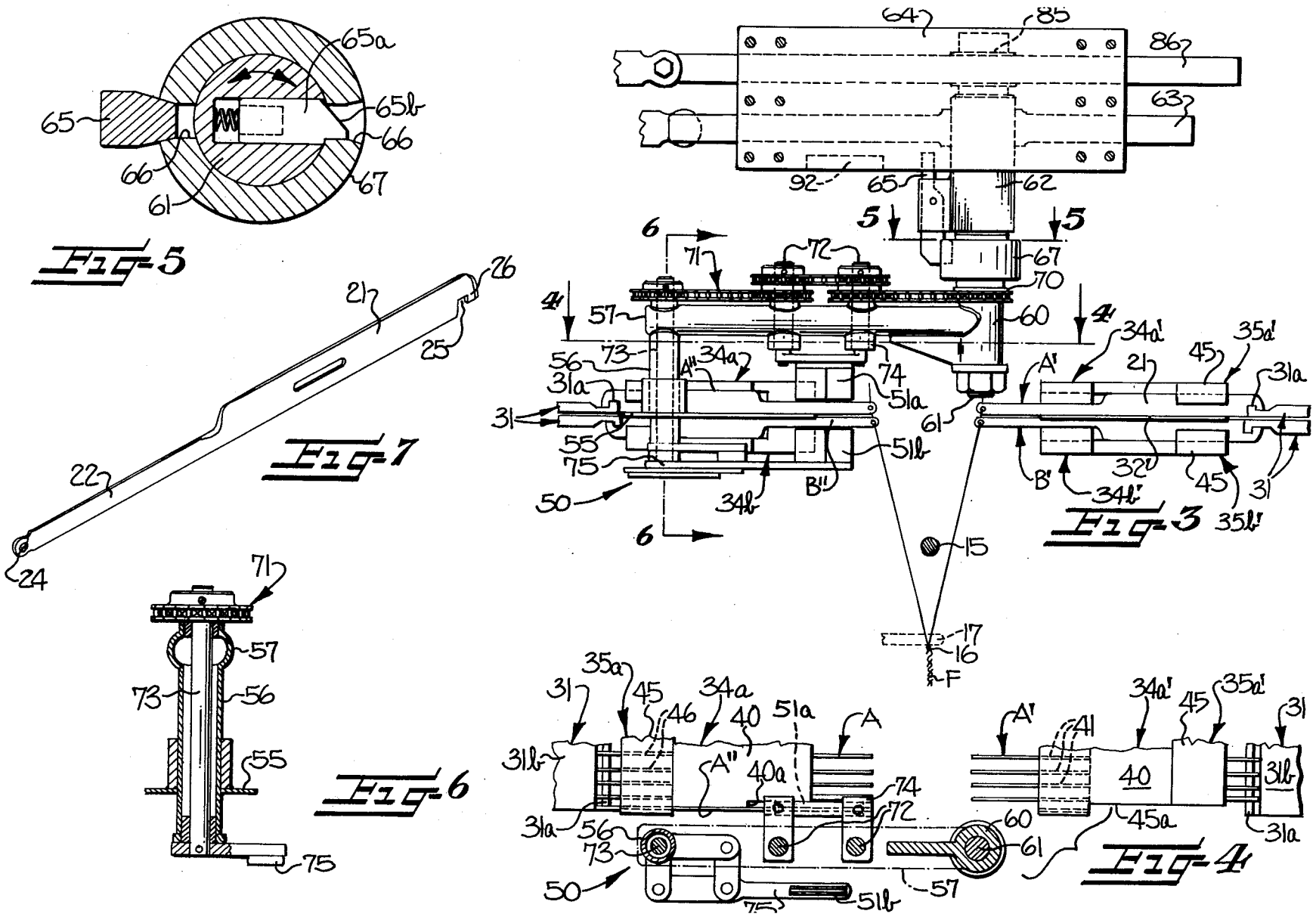
FIG. 3 is an enlarged detailed elevational view of the heddle transfer means at one end of the shed forming instrumentalities and being taken substantially along line 3—3 in FIG. 1.

FIG. 4 is a fragmentary sectional plan view taken substantially along line 4—4 in FIG. 3 and particularly illustrating parallelogram linkages for reversing the positions of the heddle engaging means 51*a*, 51*b* of the transfer means 50;

FIG. 5 is an enlarged fragmentary sectional plan view through a one-way clutch means and being taken substantially alone line 5—5 in FIG. 3;

FIG. 6 is a fragmentary vertical sectional view taken substantially along line 6—6 in FIG. 3;

FIG. 7 is a perspective view of a typical heddle for use in each of the weftwise rows;

FIGS. 8, 9, 10 and 11 are fragmentary perspective views schematically illustrating the heddle transfer means of FIGS. 1 and 3 in various stages of operation thereof; and FIGS. 12, 13, 14 and 15 are fragmentary sectional plan views similar to FIG. 4 and schematically illustrating the transfer of a heddle by the operation sequentially illustrated in FIGS. 8, 9, 10 and 11.

Figure 2:
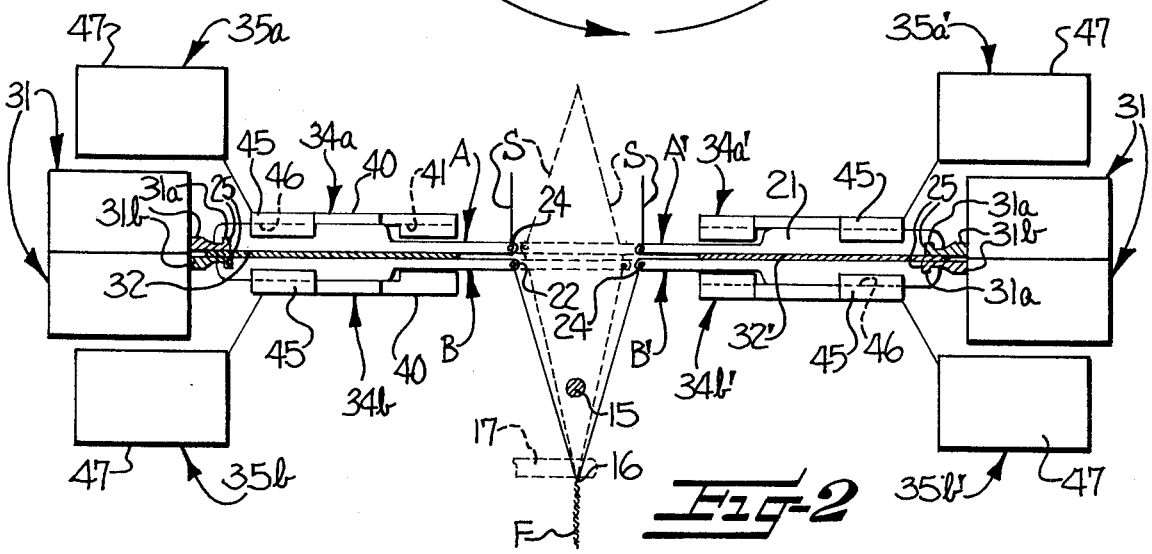
FIG. 2 is a fragmentary end elevational view taken substantially along the line 2—2 in FIG. 1.

Referring more specifically to the drawings, a weaving machine embodying the present invention has a plurality of elongate heddles arranged in weftwise rows for guiding, and forming warp sheds of, respective warp strands S (FIGS. 1 and 2). The weaving machine may include any desired number of weftwise rows of heddles, just so long as at least two such rows of heddles are provided. By way of illustration, four weftwise rows of heddles A, A′, B, B′ are shown in FIG. 2. The upper rows A, A′ constitute a first set or pair of substantially opposing weftwise rows of heddles, and the lower rows B, B′ constitute a second set or pair of substantially opposing weftwise rows of heddles, with the two sets of heddles A, A′; B, B′ being disposed warpwise of each other. More specifically, it will be observed in FIG. 2 that the lower pair of substantially opposing weftwise rows of heddles B, B′ are disposed closely adjacent to and downstream of the respective weftwise rows of heddles A, A′.

For the purposes of this disclosure, the left-hand weftwise rows of heddles A, B in FIGS. 1 and 2 will be referred to herein as the first rows in the respective first and second sets, and the right-hand weftwise rows of heddles A′, B′ will be referred to herein as the second rows in the respective first and second sets. It will be noted that both of the first rows of heddles A, B are supported adjacent one side of the path of the warp strands S to the fell 16 of the triaxial fabric F being woven, and both of the second rows of heddles A′, B′ are supported adjacent the other side of such path of the wrap strands to the fell of the fabric being woven.

As is preferred, in the illustrated embodiment of the invention the weftwise rows of heddles occupy a substantially horizontal position with the heddles being moved horizontally during the longitudinal shedding movements thereof. Consequently, the weft inserting means shown schematically at 15 in FIGS. 2 and 3, inserts the wefts in the sheds being formed of the warp strands S in a horizontal plane and on a level spaced substantially below the level of the rows of heddles. Also, the fell 16 of the triaxial fabric F, being woven from the warp strands S and the wefts, extends substantially horizontally and is spaced substantially below the level of the rows of heddles A, A′, B, B′. Thus, the fabric F at the fell 16 thereof moves downwardly in a substantially vertical path during weaving. Suitable beating-up means 17 serves to beat up each successive inserted weft against the fell 16 and operates in timed relation to the operation of the rows of heddles A, A', B, B' and the weft inserting means 15, as is well known. An example of a suitable beating-up means is disclosed in Dow et al U.S. Pat. No. 3,799,209. Accordingly, a further more detailed description of the beating-up means 17 is deemed unnecessary.

Although the rows of heddles, the supporting and controlling mechanisms therefor, and the fell 16 of the fabric F are illustrated as occupying horizontal positions, it is to be understood that they may occupy any desired positions, such that the direction of movement of the fabric at the fell 16 during weaving may be in the upward direction or the horizontal direction or in any desired angular direction, without departing from the invention.

Each heddle may be of substantially the type disclosed in copending application Ser. No. 582,245, filed May 30, 1975, owned in common with the present invention. Accordingly, it will be observed in FIG. 7 that each heddle is of elongate form and is relatively thin and comprises an elongate body portion 21 of predetermined width, with an elongate, narrow, reduced width frontal portion 22 extending forwardly from body portion 21. The reduced width frontal portion 22 may be about one-half as wise as body portion 21 and terminates in a substantially rounded or substantially semicircularly shaped free end defining the front end of the respective heddle. Each heddle has a strand guide opening or eye 24 therethrough closely adjacent the free front end thereof for guidingly engaging the respective warp strand S. Thus, it will be observed in FIGS. 2 and 3 that the warp strands S extend through the respective heddles to the fell 16 of the triaxial fabric being woven. The warp strands may be directed to the heddles from a suitable supply source, not shown, remote from the rows of heddles A, A', B, B'.

The heddles in each row A, A', B, B' may be arranged in any desired spaced relationship. It is preferred, however, that the distance between immediately adjacent heddles in each row is at least about equal to the thickness of each heddle so as to accommodate passage of the warp strands S through the heddles of each respective row and between immediately adjacent heddles warpwise of the heddles through which particular warp strands extend. For this reason it also is preferred that the heddles in the first or upper set A, A' are staggered weftwise relative to the heddles in the second or lower set B, B' during each weft insertion. Desirably, the heddles are quite thin and the distance between immediately adjacent heddles in each weftwise row is about the same as the thickness of each heddle so as to permit weaving triaxial fabrics of high density from fine warp strands. Many of the heddles are omitted from each row in FIGS. 1 and 8–11 for purposes of clarity.

Referring again to FIG. 7, it is preferred that the opposite longitudinal edges of the heddle extend substantially parallel to each other and, since the elongate frontal portion 22 is of substantially less width than the body portion 21, the body portion defines a projecting shoulder portion on the heddle, which shoulder portion is adapted to be engaged by a shifting bar of a heddle shifting means for shifting each respective row of heddles weftwise during operation of the weaving machine, as will be later explained. Each heddle also is provided with means adapted to be engaged for imparting longitudinal shedding movements thereto. To this end, the rear portion of each heddle, remote from the frontal portion 22 thereof, is provided with a cutout 25 partially defined by a hook-shaped projection 26 on the rear end of the body portion 21 of each heddle.

As best shown in FIG. 2, the cutouts 25 in the heddles of each row A, A', B, B' are engaged by an elongate rib 31*a* of a respective shedding means 31, there being one of the shedding means 31 for moving each respective weftwise row of heddles A, A', B, B' longitudinally between the retracted position shown in solid lines in FIG. 2 and the extended position represented by rows A', B shown in broken lines in FIG. 2. In this regard, it will be noted that the proximal longitudinal edges of the heddles in the two first rows A, B may slide against the respective upper and lower surfaces of a first stationary guide plate 32, and the proximal longitudinal edges of the heddles in the second rows A', B' may slide against the respective upper and lower surfaces of a second stationary guide plate 32'. The stationary guide plates 32, 32' may be of a length about equal to the width of the triaxial fabric F and the proximal edges of plates 32, 32' are spaced apart from each other (FIG. 1) to provide an adequate opening for the passage of the warp strands S therethrough and for the formation of the warp sheds thereof with the warp strand guide openings 24 in the heddles A, A', B, B' positioned forwardly beyond the proximal edges of guide plates 32, 32'.

Each warp shedding means 31 may include a weftwise extending heddle shedding bar 31*b*, each of which is movable forwardly and rearwardly according to a predetermined pattern and which has the elongate weftwise extending projection or rib 31*a* thereon for engaging the cutouts 25 and hook-shaped projections 26 (FIGS. 2, 3 and 7) of the respective rows of heddles A, A', B, B'. It is to be noted that the heddles in rows A, B are being moved from left to right and the heddles in rows A', B' are being moved from right to left in FIG. 2 whenever they are being moved forwardly to extended open shed positions. Also, whenever the heddles are being moved to the retracted open shed positions shown in solid lines in FIG. 2, the heddles are being moved rearwardly.

For the further control of the heddles during formation of warp sheds and for shifting the heddles weftwise, heddle guide means and heddle shifting means are provided for each row of heddles A, B, A', B'. The heddle guide means for the rows A, B, A', B' are respectively designated at 34*a*, 34*b*, 34*a'*, 34*b'*, and the heddle shifting means for the rows of heddles *A, B, A', B'* are respectively designated at 35*a*, 35*b*, 35*a'*, 35*b'*.

Each heddle guide means 34*a*, 34*b*, 34*a'*, 34*b'* may take the form of an elongate weftwise guide member or bar 40 (FIGS. 1, 2 and 8–11) suitably supported so that its surface facing toward the corresponding guide plate 32 or 32' is spaced from such guide plate a distance somewhat greater than the width of the reduced width frontal portions 22 (FIGS. 2 and 7) of the corresponding heddles. The surface of each guide bar 40 adjacent the corresponding stationary guide plate 32 or 32' is in the form of a plurality of projecting teeth or wall members defining a weftwise row of passageways 41 (FIGS. 2 and 8) for guiding the respective heddles in movement from and to the aforementioned open shed retracted and extended positions.

The heddle shifting means 35*a*, 35*a*′, 35*b*, 35*b*′ are provided for moving weftwise the respective heddles A, A′, B, B′ and warp strands S engaged thereby during weaving so as to shift each heddle in each row from one passageway 41 to another and thereby move the warp strands from one weftwise location to another so that the warp strands may extend obliquely with respect to the wefts. Accordingly, each heddle shifting means comprises an elongate weftwise extending and weftwise movable heddle shifting member or bar 45 positioned rearwardly of and in sliding engagement with, or in close proximity to, the respective heddle guide bar 40. Each heddle shifting bar 45 is provided with a weftwise row of closely spaced forwardly and rearwardly extending teeth or wall members to define a weftwise row of passageways 46 for guidingly receiving therein the shoulder portions defined by the body portions 21 (FIGS. 2 and 7) on the heddles in the respective row. The surfaces of the heddle shifting bars 45 facing toward the stationary guide plates 32, 32′ are spaced from such guide plates to accommodate the shedding movements of the respective heddle shedding bars 31*b* in the space between bars 45 and plates 32, 32′.

Suitable control means 47 is shown schematically in the form of a block (FIG. 2) operatively connected to each heddle shifting bar 45 for imparting an active weftwise shifting movement or stroke to each heddle shifting bar 45 following each of, or certain of, the rearward or retracting movements of the respective shedding bars 31*b*. It is to be understood that successive active weftwise strokes of each heddle shifting bar 45 may be effected selectively in either weftwise direction with each such active stroke being effected for a distance about equal to an integral multiple of the distance between the centers of adjacent passageways 46. However, the sum of all of the active weftwise strokes of each heddle shifting bar 45 normally should be such that the heddles in any given row will be subject to being transferred, one at a time, away from the same end of such given row to the adjacent end of another of the rows of heddles.

In the illustrated embodiment of the present invention it is to be assumed that successive heddles in the two first rows A, B are delivered to the ends of the rows A, B nearest the observer in FIGS. 2, 3 and 8–11 and that the successive delivered heddles are transferred, by a first transfer means 50 to be presently described, to the adjacent ends of the respective second substantially opposing rows A′, B′. Of course, it is apparent that the successive heddles are delivered to the other, leading, ends of the latter rows A′, B′ and are transferred to the adjacent trailing ends of the two first rows of heddles A, B by a second transfer means 50′. In any event, it is preferred that the control means 47 for each heddle shifting bar 45 imparts an inactive stroke to the respective heddle shifting bar 45 for returning the same to its original position following each active stroke thereof.

Following each active weftwise stroke of each heddle shifting bar 45, it is to be understood that the respective shedding means 31 moves all the heddles in the respective row forwardly to extended position so as to move the body portions 21 of the corresponding heddles forwardly out of engagement with the passageways 46 in the respective heddle shifting bars 45, thus permitting the heddle shifting bars 45 to return to their original positions in an inactive stroke thereof without then being encumbered by, or imparting weftwise movement to, the respective heddles.

In the particular illustrated embodiment of FIG. 2, it may be assumed that the heddles in the first rows A, B are disposed in substantially longitudinal alignment with the respective heddles in the second rows A′, B′, but with the heddles in the first set A, A′ being staggered relative to the heddles in the second set B, B′. Thus whenever any one of the rows of heddles occupies the extended position, the substantially opposing row in the respective pair occupies a retracted position, and vice versa. For example, it will be observed in FIG. 2 that, whenever the second row of heddles A′ of the upper or first set occupies the fully extended position shown in broken lines, the opposing first row of heddles A occupies the fully retracted position shown in solid lines. Conversely, whenever the upper first row of heddles A occupies the extended position, the upper second row of heddles A′ in the same pair would occupy the retracted position shown in solid lines in FIG. 2. The heddles B, B′ would also function similar to the heddles A, A′. Although the illustrated embodiment has the heddles of each first row substantially aligned with the heddles in the respective opposing or second row, it is to be understood that the heddles in each row may occupy a different position from that described with respect to the heddles in the other row without departing from the invention.

Much of the structure and operation described hereinabove is of importance to the present invention as background, and should be understood as being subject to separate protection. In accordance with the particular invention to be here described and as indicated above, heddle transfer means 50, 50′ are provided at opposite sides of the machine for transferring successive heddles from one end of each row to the adjacent end of another row. In the illustrated embodiment, each successive heddle is transferred from the leading end of each respective row of heddles A, B, A′, B′ to the adjacent trailing end of the respective substantially opposing row of heddles. Both heddle transfer means 50, 50′ may be of substantially the same construction. Therefore, the second transfer means 50′ is represented only by a broken-line block in FIG. 1, and only the first heddle transfer means 50 will be described in detail in association with those ends of the rows of heddles A, B, A′, B′ nearest the observer in FIGS. 2, 3 and 8–11.

Figure 8:
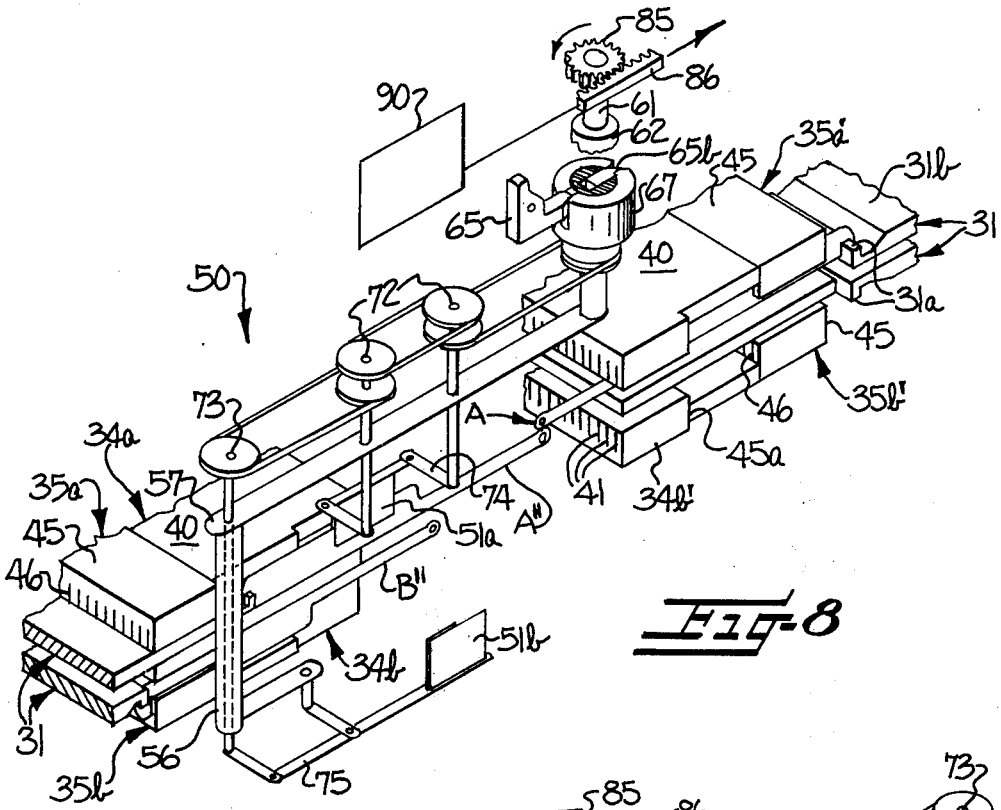
Figure 12:
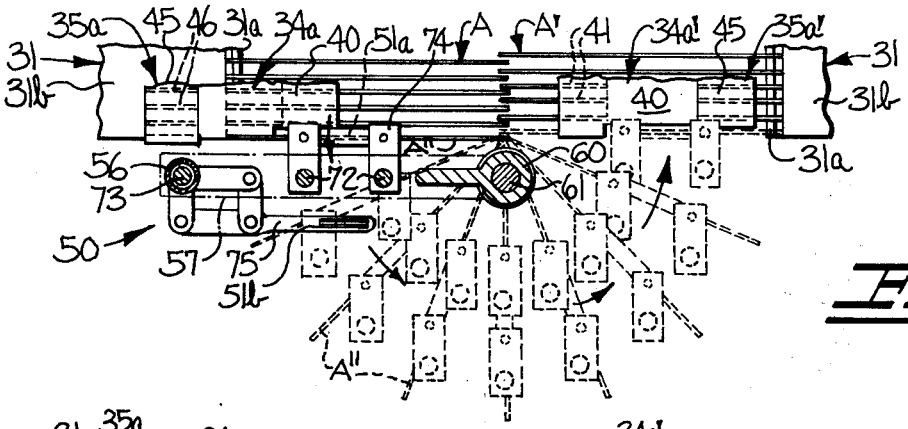

As shown in FIGS. 3 and 4, heddle transfer means 50 comprises a pair of alternatively operable first and second heddle engaging and receiving means which may take the form of respective first and second substantially U-shaped or bifurcated heddle transferring receptacles 51*a*, 51*b*. These first and second heddle receptacles 51*a*, 51*b* are alternatively effective for engagingly receiving and moving leading heddles from the leading ends of the respective rows of heddles A, B to the adjacent trailing ends of the respective substantially opposing rows of heddles A′, B′. To aid in the description of the heddle transfer means 50, the leading endmost heddle in the upper first row A is indicated at A″ and the leading endmost heddle in the lower first row B is indicated at B″ in the respective FIGS. 3 and 8. It should be noted that, when the first heddle receptacle 51*a* occupies a fully operative heddle receiving position adjacent the leading end of the row of heddles A as shown in FIGS. 8 and 12, the second heddle receptacle 51*b* occupies an inactive position spaced outwardly from the adjacent leading end of the lower row of heddles B, and vice versa (see FIGS. 10 and 14).

The opposing substantially parallel walls of the respective first and second heddle receptacle 51*a*, 51*b* are relatively thin and define respective heddle engaging passageways for receiving therein heddles to be transferred. The walls of such passageways are thin so that they will not interfere with other adjacent heddles in the corresponding rows when the heddle receptacles 51*a*, 51*b* occupy respective fully active heddle receiving positions and when they occupy respective heddle transferring or releasing positions. The opposing sidewalls of each heddle receptacle 51*a*, 51*b* may by yieldably biased toward each other so as to yieldably retain successive heddles therein during transfer operations.

The open proximal ends of the passageways defined by the first and second heddle receptacles 51*a*, 51*b* straddle and face toward a common transfer plate 55 suitably secured to the lower portion of a tubular bracket 56 (FIGS. 3 and 6). Transfer plate 55 is aligned with the guide plates 32, 32' when the plate 55 occupies respective heddle-receiving and heddle transferring positions. Transfer plate 55 is omitted in FIGS. 1, 4 and 8–11 for the purpose of clarity.

Bracket 56 is suitably connected to and depends from one free end portion of a substantially horizontally disposed swing arm or transfer arm 57. The other end of arm 57 has a sleeve 60 fixed thereon which is, in turn, suitably secured to or keyed on the lower portion of a substantially vertically disposed carrier shaft or pivot shaft 61.

It will be noted that the axis of carrier shaft 61 extends substantially perpendicular to the fell 16 of the fabric F and lies in a plane between the opposing rows of heddles A, A', B, B'. As preferred, the axis of carrier shaft 61 also is positioned closely adjacent and to one side of the point at which the free ends of the leading heddles A'', B'' are positioned when they occupy fully extended positions. This facilitates the transfer of each successive leading heddle from one row to the trailing end of another substantially opposing row without materially altering the position of the respective warp strand S in the shed during such transfer. In particular, such transfer occurs without deflection of the warp strand outwardly beyond substantial alignment with the selvage of the fabric being formed, so as to minimize fluctuations in tensioning of the warp strand.

The carrier shaft 61 extends upwardly from sleeve 60 and is mounted for oscillation in a transfer carriage 62 secured to or otherwise connected to an elongate slide member 63. Slide member 63 is mounted for longitudinal movement, forwardly and rearwardly, in a support bracket 64 suitably secured to a fixed part of the weaving machine. For purposes to be later described, means are provided for reciprocating transfer carriage 62 to and fro relative to support bracket 64 and for oscillating carrier shaft 61 through about one-half a revolution.

A spring-biased latch member 65 (FIGS. 3 and 5) is pivotally mounted on transfer carriage 62 and is urged toward shaft 61 so that latch member 65 normally engages one or the other of a pair of diametrically opposed cavities or notches 66 in the wall of a one-way clutch member 67 (FIG. 5). As shown, clutch member 67 may take the form of a sleeve or collar loosely mounted on a medial portion of carrier shaft 61 between transfer arm 57 and carriage 62. The lower portion of one-way clutch member 67 has a sprocket wheel 70 in fixed axial relation thereto. Suitable sprocket and chain connections 71 drivingly connect sprocket wheel 70 to a pair of first heddle transfer switching shafts 72 (FIG. 3) and to a second heddle transfer switching shaft 73. The first switching shafts 72 are rotatably mounted in a medial portion of transfer arm 57, and the lower portions of shafts 72 have a suitable parallelogram linkage 74 thereon to which the upper portion of the first heddle receptacle 51*a* is suitably secured.

As shown in FIG. 6, the second heddle transfer switching shaft 73 is rotatably mounted in the tubular bracket 56 and extends below heddle transfer plate 55 for supporting thereon a suitable parallelogram linkage 75. The lower portion of the second heddle receptacle 51*b* is suitably secured to the linkage 75 as best shown in FIGS. 3 and 4. It is to be noted that the parallelogram linkages 74, 75 are arranged so that, whenever the first heddle receptacle 51*a* is positioned to one side of the vertical plane of heddle transfer arm 57, the second heddle receptacle 51*b* is positioned to the opposite side of the vertical plane of transfer arm 57, and vice versa.

As shown in FIGS. 1 and 8–15, the leading end portion of each stationary guide bar 40 of the respective left-hand heddle guide means 34*a*, 34*b* is cut away or recessed, as at 40*a*, so as to expose each successive leading heddle as it reaches the leading end of the respective guide bar 40 and as such leading heddle occupies the extended position heretofore described. In other words the leading endmost passageway 46 (FIG. 4) in bar 45 of shifting means 35*a* then is positioned outwardly of any passageways 41 in the bar 40 of guide means 34*a*. Similarly, the trailing end portions of the two heddle shifting bars 45 of the right-hand heddle shifting means 35*a'*, 35*b'* for the respective upper and lower second rows of heddles A', B' are cut away or recessed, as at 45*a*, so that during each respective heddle transfer operation, the bars 45 of the respective heddle shifting means 35*a'*, 35*b'* are clear of and out of alignment with the adjacent trailing endmost passageways 41 in the respective guide bars 40 of the heddle guide means 34*a'*, 34*b'*. The cutaway trailing end portions 45*a* are provided at the trailing ends of the right-hand heddle shifting bars 45 for facilitating the proper positioning of the heddles being transferred to the trailing ends of the rows of heddles A', B' as will be later described.

The cutaway leading end portions 40*a* of bars 40 of the guide means 34*a*, 34*b* for the respective first rows of heddles A, B may be formed or defined by simply omitting the leading end walls of the leading passageways of the latter guide bars or by simply foreshortening the leading ends of the latter bars 40 relative to the leading ends of the shifting bars 45 of the respective shifting means 35*a*, 35*b*. Also, the cutaway trailing end portions 45*a* of the bars 45 of shifting means 35*a'*, 35*b'* for the respective second rows of heddles A', B' may be formed or defined by omitting the trailing end walls of the trailing passageways of the latter shifting bars 45 or by foreshortening the same relative to the trailing endmost passageways 41 in the respective guide bars 40 for the same rows of heddles. If further clearance is provided for the heddle receptacles 51*a*, 51*b*, the cutaway portions 45*a* may extend partially along the trailing ends of the corresponding guide bars 40 as shown in the right-hand portion of FIG. 4.

Referring again to the one-way clutch member 67 shown in FIG. 5, it will be observed that the diametrically opposed notches 66 therein are also adapted to be alternatively engaged by a spring-biased or yieldable clutch dog 65*a*. Clutch dog 65*a* is radially movable in a cavity in carrier shaft 61 and is normally biased outwardly toward the inner surface of clutch member 67 or into engagement with one or the other of the notches 66. One side of the radially outer end portion of clutch dog 65*a* has a suitable cam surface 65*b* thereon, which cam surface may be rounded or beveled so that, whenever transfer shaft 61 is rotated in a counterclockwise direction in FIG. 5, with latch member 65 engaging one of the notches 66, the clutch member 67 will remain stationary as the cam surface 65*b* is moved inwardly in engagement with the inner surface of clutch member 67. Thus, clutch dog 65*a* is placed in a disengaged condition and permits carrier shaft 61 to rotate without rotating the clutch member 67.

Figure 9:
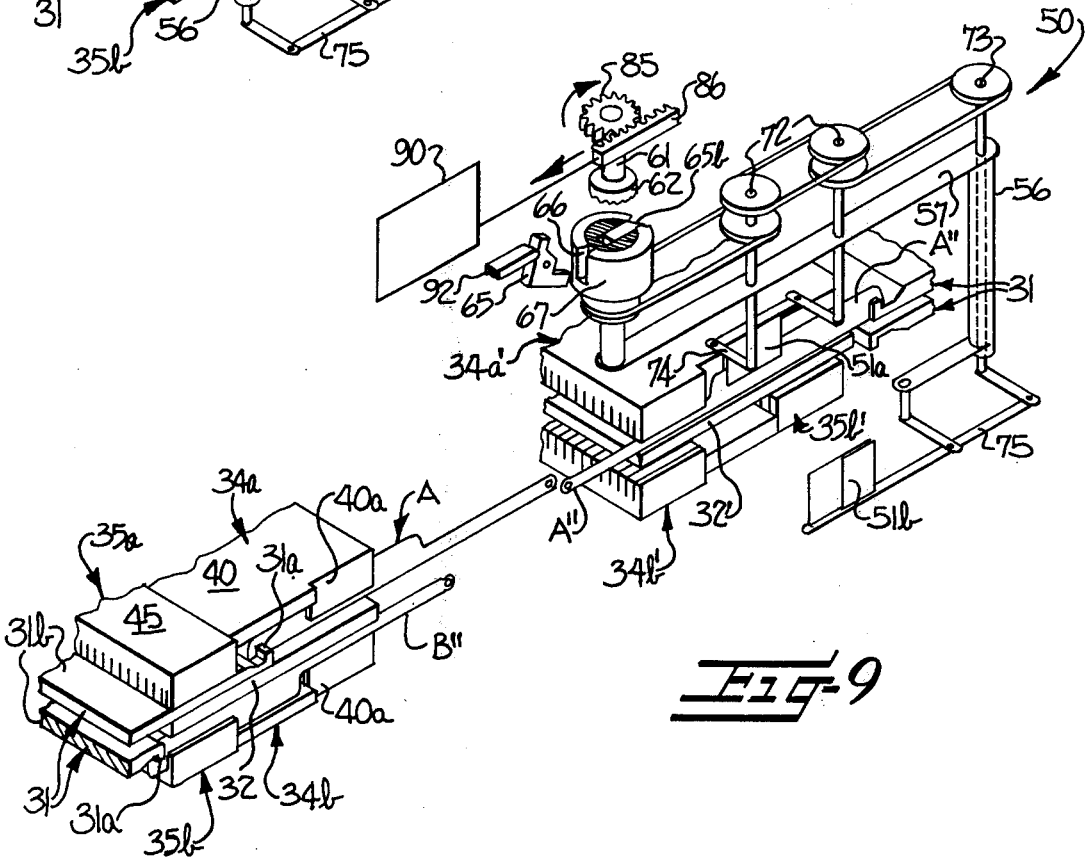
Figure 10:
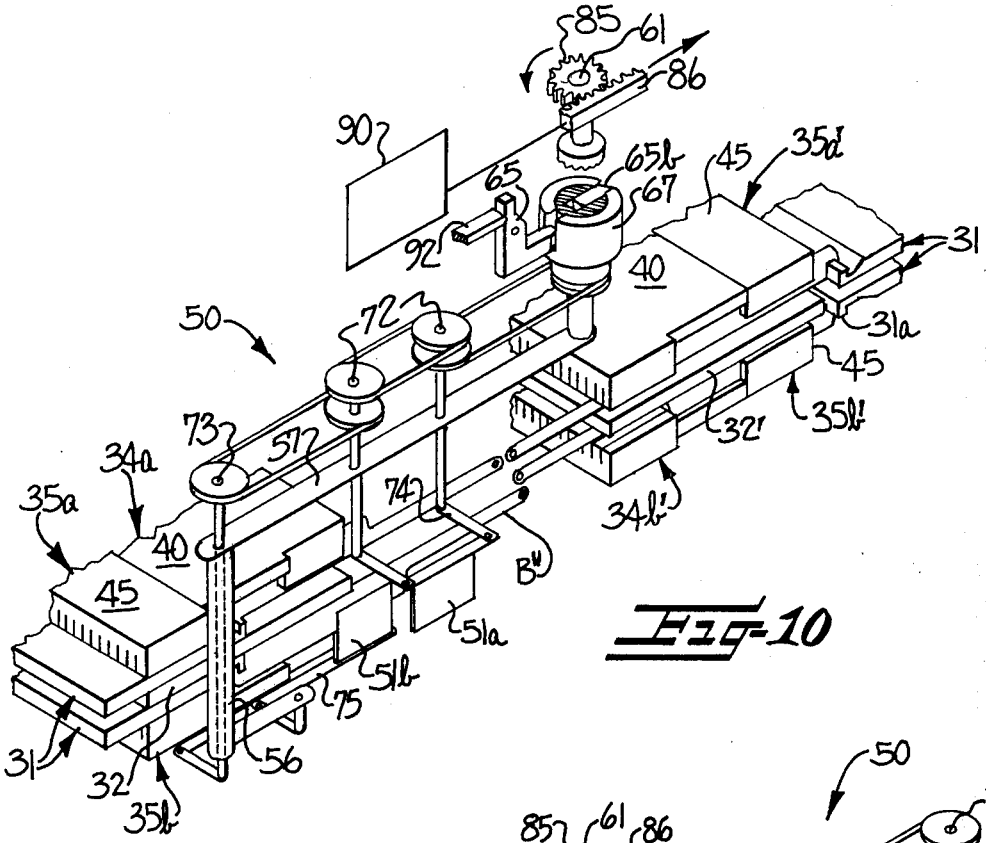
Figure 11:
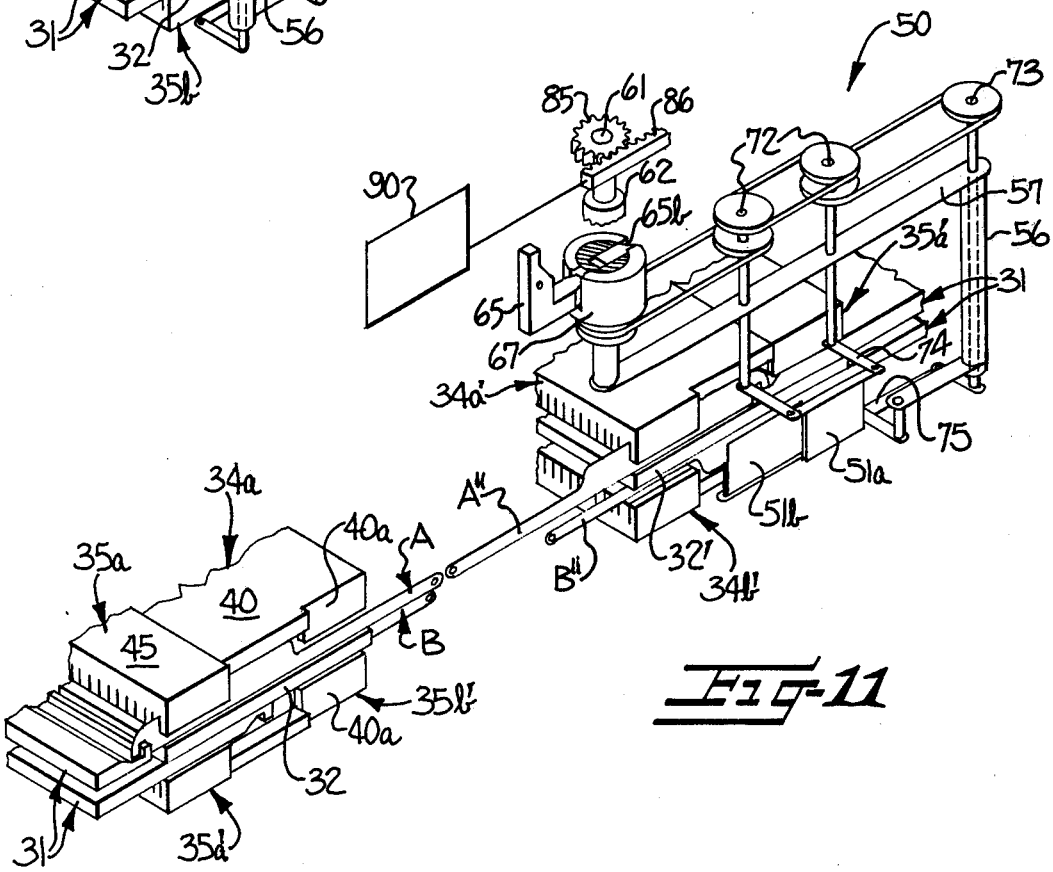

It is apparent that such counterclockwise rotation of shaft 61 is effective through about one-half a revolution thereof for effecting a respective active, heddle transferring, stroke to heddle transfer arm 57 from the position shown in FIGS. 3, 8 and 10 to the position shown in FIGS. 9 and 11. Since the one-way clutch member 67 is restrained from rotation by latch member 65 during each active stroke of transfer arm 57, it follows that the sprocket wheel 70 is also restrained from rotation and thereby imparts counterclockwise rotation to the shafts 72, 73, as viewed looking down at the upper ends of the shafts 72, 73 in FIGS. 8–11. Thus, the shafts 72, 73 rotate the respective parallelogram linkages 74, 75 and thereby reverse the relative positions of the first and second heddle receptacles 51*a*, 51*b* during each active stroke of transfer arm 57. Active strokes are indicated in FIG. 12 for upper rows A, A′ of heddles and in FIG. 14 for lower rows B, B′.

Figure 13:
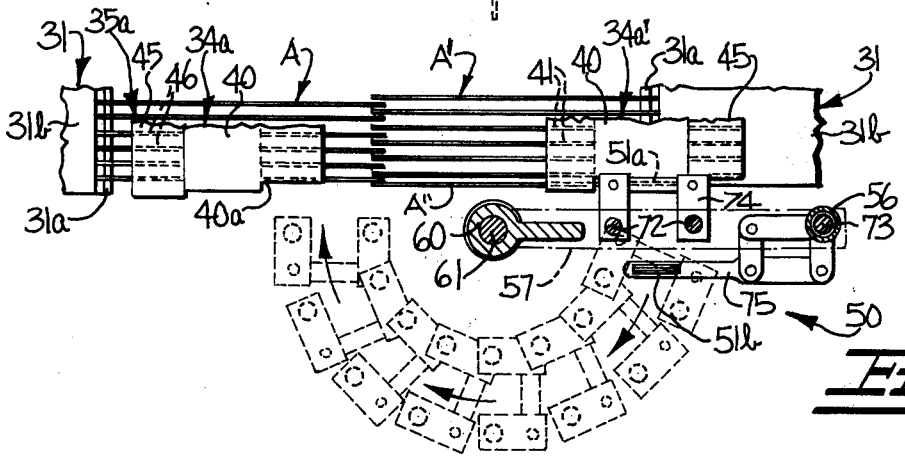
Figure 15:
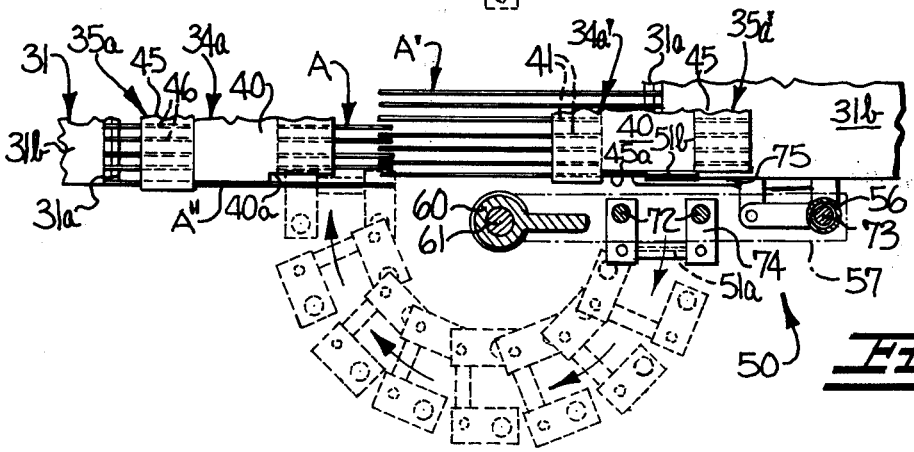

It should be noted, however, that sprocket wheel 70 does not drive the switching shafts 72, 73 during the inactive, clockwise, strokes of transfer arm 57 from the position of FIGS. 9 and 11 to the position of FIGS. 8 and 10. To this end, prior to each inactive stroke being imparted to transfer arm 57, latch member 65 is withdrawn out of engagement with the respective notch 66 in clutch member 67 by means to be presently described. Additionally, the straight side of the clutch dog 65*a* faces in the clockwise direction in FIG. 5 so that, upon shaft 61 being rotated in the clockwise direction, both the transfer arm 57 and the one-way clutch member 67 rotate with carrier shaft 61 throughout about one-half a revolution thereof to complete a respective inactive stroke of transfer arm 57 and the heddle receptacles 51*a*, 51*b* carried thereby. Inactive strokes are shown in FIGS. 13 and 15.

Since the switching shafts 72, 73 are caused to rotate in the same direction during each successive active stroke of transfer arm 57, it can be appreciated that, on alternate inactive strokes of heddle transfer arm 57, the first heddle receptacle 51*a* will occupy an operative position adjacent or in the corresponding cutaway portion or recess 40*a* of the guide bar 40 of the heddle guide means 34*a*. Thus, the first heddle receptacle 51*a* will be positioned to receive the next succeeding leading heddle A″ following the shifting of such heddle to the leading end of the respective row of passageways 41 and during the subsequent forward movement of such leading heddle A″ from the fully retracted position to the fully extended position shown in FIG. 8. The received heddle is then transferred by pivotal movement in a horizontal plane as indicated in FIG. 12.

Figure 14:
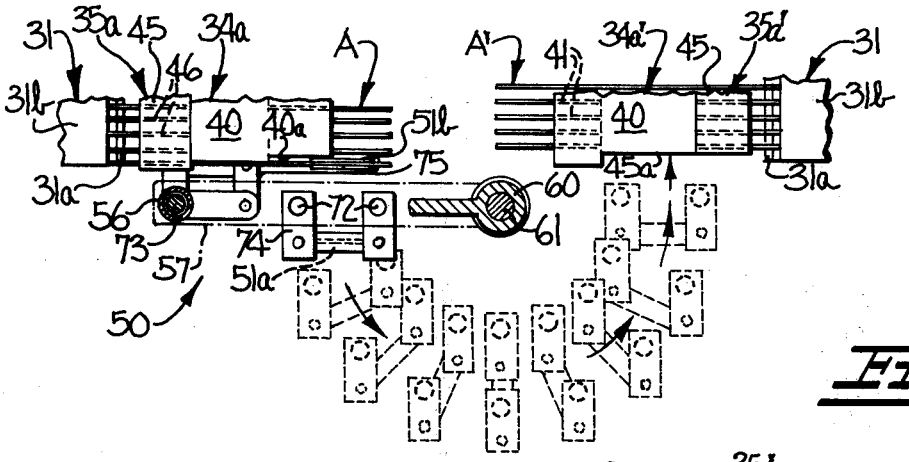

On intervening active strokes of transfer arm 57, the second heddle receptacle means 51*b* will occupy an operative positon adjacent or in the corresponding cutaway portion 40*a* of heddle guide means 34*b*. The second heddle receptacle 51*b* then is so positioned as to receive the next succeeding leading heddle B″ (FIG. 10) from row B following the shifting of such leading heddle to the leading end of the respective row of passageways 41 and during the subsequent forward movement of the leading heddle B″ from the retracted position to the extended position of FIG. 10. The received heddle is then transferred by pivotal movement, during which the alternate first receptacle 51*a* has its position reversed as shown in FIG. 14.

Referring again to the first heddle receptacle 51*a*, it will be observed in FIG. 8 that the first heddle receptacle 51*a* is so arranged that the slot or passageway defined thereby slidably receives the body portion 21 of the respective leading upper heddle A″ during the movement of heddle A″ from the retracted position of FIGS. 1, 3 and 4 to the extended position of FIG. 8. Thus, as the shaft 61 and transfer arm 57 are subsequently rotated in a counterclockwise direction in FIG. 8, and while the relative positions of the first and second heddle receptacles 51*a*, 51*b* are being substantially reversed in the manner heretofore described, it can be appreciated that the heddle A″ is being moved in a predetermined path in a plane substantially parallel to the fell 16 of the triaxial fabric F and about an axis substantially perpendicular to the fell and lying in a plane between the substantially opposing rows of heddles in each set. Also, because of the axis of shaft 61 being located adjacent to but offset outwardly from the normal position occupies by the free front end of the leading heddle A″ when it is moved to the extended position of FIG. 8, the eye or warp strand opening 24 of the respective heddle A″ is very close to the axis about which the heddle A″ is being moved during the transfer operation (FIG. 12), thus avoiding placing the warp strand extending therethrough under undue stress during the transfer operation.

By the time that the half of a revolution in an active stroke of the shaft 61 and transfer arm 57 has been effected, the two heddle receptacles 51*a*, 51*b* will have completed the substantial reversing of their relative positions so that the first heddle receptacle 51*a* will be received in the recess or cutaway portion 45*a* in the trailing end of the upper heddle shifting bar 45 of the heddle shifting means 34*a*′. Also, the right-hand upper heddle shedding bar 31*b* will then be occupying the retracted position shown in FIGS. 1–4 and 8–10, as a result of which the cutaway 25 in the rear portion of the heddle A″ being transferred will be positioned in engagement with the rib 31*a* on the corresponding shedding bar 31*b*. Thereupon, the now transferred heddle A″, occupying the position of FIG. 9, will be moved forwardly with the other heddles in the row A′ to the extended position shown in broken lines in FIG. 2, thus moving the now transferred heddle A″ out of engagement with the first heddle receptacle 51*a* and into the endmost or trailing passageway 41 (FIG. 4) in bar 40 of heddle guide means 34*a*′. Such transfer operation of the transfer means 50 is effected in timed relation to the operation of heddle shedding means 31, shifting means 35*a*, 35*b*, 35*a*′, 35*b*′, weft inserting means 15 and beating-up means 17, and may be effected during a single pick in the operation of the weaving machine. Upon the next succeeding pick or following a predetermined number of additional picks of the weaving machine, a subsequent operation of the heddle transfer means 50 may occur. Also, similar operations of the second heddle transfer means 50' may be effected at the desired spaced intervals.

In any event, following the transfer of the heddle A'' to the position of FIG. 9 and the subsequent movement of heddle A'' to extended position, it is apparent that, during the next inactive and succeeding active strokes of the heddle transfer arm 57 (FIGS. 13 and 14), a leading heddle B'' will be transferred from the leading end of the first bottom row B to the trailing end of the second bottom row B' by the second receiver 51*b* in substantially the same manner as that described with respect to the transfer of the heddle A'' by the first receiver 51*a*, with the relative positions of the two heddle receptacles 51*a*, 51*b* again being substantially reversed to complete a cycle in the operation of the apparatus. Accordingly, a further detailed description of the operation of the transfer means 50 in effecting the transfer of each successive leading heddle B'' from the lower first row of heddles B to the lower second row of heddles B' will not be given.

It is to be noted that, since a single heddle shedding bar 31*b* is shown in FIG. 2 for longitudinally moving all of the heddles in each respective row A, A', B, B' from and to open shed retracted and extended positions, it is apparent that during respective transfer operations the leading heddle A'' (FIG. 8) is moved into engagement with the first heddle receptacle 51*a* of transfer means 50 at the same time as the respective upper left-hand shedding bar 31*b* moves all of the heddles in the same row A from retracted position to extended position. Also, it can be appreciated that the leading heddle from row A becomes the trailing heddle of row A' when the heddle A'' is transferred from the position of FIG. 8 to that of FIG. 9. Thus, the trailing end heddle A'' in FIG. 9 is moved out of engagement with the respective heddle receptacle 51*a* of transfer means 50 at the same time as the respective shedding bar 31*b* moves all of the heddles in the upper second row A' from the retracted position to the extended position.

Similarly, the leading end heddle B'' to be transferred from row B is moved into engagement with the respective second heddle receptacle 51*b* at the same time as the respective lower left-hand shedding bar 31*b* of FIG. 2 moves all of the heddles in the same row B from the retracted position of FIGS. 1–4, 8 and 9 to the extended position of FIG. 10. Of course, upon the subsequent transfer of heddle B'' to the position shown in FIG. 11, heddle B'' then becomes the trailing end heddle in the row B', and this trailing end heddle is also moved out of engagement with the second heddle receptacle 51*b* at the same time as the respective shedding bar 31*b* moves all of the heddles in the same row B' from the retracted position to the extended position. It is to be understood, however, that other suitable means may be provided for moving the endmost heddles in the several rows A, A', B, B' from and to retracted and extended independently of the remaining heddles in the respective rows, if desired, during the corresponding heddle transfer operations, without departing from the invention.

From the foregoing description, it is apparent that the shaft 61 is rotated about one-half revolution, first in one direction and then in the opposite direction, in order to transfer a heddle from a leading end of one row of heddles to the adjacent trailing end of another substantially opposing row of heddles. Accordingly, it will be observed in FIGS. 1, 3 and 8–11 that the upper end of carrier shaft 61 has a pinion or gear 85 thereon which is engaged by a rack 86 guided for substantially horizontal sliding movement in the bracket 64 heretofore described.

Corresponding ends of the rack 86 and the slide bar 63 are operatively connected with suitable control means, indicated schematically at 90 in FIGS. 8–11, for imparting the desired motions to the rack 86 and the slide bar 63. In this regard, it will be noted that when the rack 86 is moved from left to right in FIGS. 1, 3, 8 and 10, the shaft 61 and heddle transfer arm 57 are caused to move in a counterclockwise direction, thus effecting an active stroke thereof. Conversely, when the rack 86 is moved from right to left in FIGS. 1, 3, 9 and 11, this rotates the shaft 61 in a clockwise direction, thus imparting an inactive stroke to the shaft 61 and transfer arm 57.

It will be noted that carriage 62 and its slide bar 63 are mounted for forward and rearward movements relative to the supporting bracket 64 for the purpose of effecting the inactivation of the clutch latch member 65 before each clockwise movement of shaft 61 and arm 57 is effected in FIGS. 9 and 11. Accordingly, the control means 90 may include a cam or any other suitable means for imparting a right-to-left movement to slide bar 63 and carriage 62 of transfer means 50 prior to any relative movement being effected between rack 86 and pinion 85 for rotating shaft 61 in a clockwise direction in FIGS. 9 and 11.

The stroke of carriage 62 from right to left in FIG. 3 is of such extent that the upper portion of latch member 65 is moved into engagement with a stationary abutment 92 carried by bracket 64. During such movement of latch member 65 into engagement with abutment 92, the latch member 65 is pivoted about its substantially horizontal axis to withdraw the same from engagement with the corresponding notch 66 (FIG. 5) in clutch member 67. Thereupon, as rack 86 subsequently starts to move from right to left in FIGS. 3, 8 and 11 relative to carriage 62 and bracket 64, the last-mentioned notch 66 in clutch member 67 is moved out of registration with the latch member 65. Immediately upon the corresponding notch 66 in clutch member 67 moving out of alignment with the latch member 65, it follows that carriage 62 then may be returned to substantially its original position, which is the position in which it is illustrated in FIGS. 1 and 3. The clutch dog 65*a* (FIG. 5) then will impart rotation to clutch member 67 concurrently with the rotation being imparted to shaft 61 in the clockwise direction, thus insuring that the switching shafts 72, 73 will not rotate and reverse the relative positions of the heddle receptacles 51*a* and 51*b* during the inactive strokes of heddle transfer means 50.

The disclosed embodiment of the weaving machine illustrates one mode of carrying out the principles of the invention. However, it is contemplated that many modifications may be made in the machine without departing from the invention. For example, while it is preferred that each leading heddle to be transferred occupies a fully extended open shed position upon initiation of outward movement thereof away from the respective row of heddles, and that the latter leading heddle occupies a fully retracted position upon termination of movement of such heddle about the axis represented by shaft 61, it is contemplated that the leading heddle may occupy either fully retracted or fully extended position, or an intermediate position therebetween, at either or both the initiation and termination of movement thereof from one row to another. The location of the cutaway portions 40*a*, 45*a* in the ends of the guide bars 40 and shifting bars 45 also may be formed as desired to accommodate any desired modifications in the positions of the heddles to be transferred. It is also contemplated that certain triaxial fabric constructions may render it desirable or necessary to transfer more than one heddle at a time, as when two adjacent warp strands are manipulated in common. Still other modifications will be apparent to skilled artisans without departing from the invention.

It is thus seen that we have provided an improved triaxial fabric weaving machine of the type wherein a plurality of elongate heddles are arranged in rows for guiding warp strands, for forming the warp strands guided thereby into warp sheds through which wefts are inserted, and for shifting the warp strands weftwise, in which heddle transfer means are provided for engagingly receiving and moving a heddle from one end of each row to the adjacent end of another row.

In the drawings and specification, there has been set forth a preferred embodiment of the invention, and although specific terms are employed, they are used in a generic and descriptive sense only and not for purposes of limitation.

We claim:

1. A weaving machine for making triaxial fabrics comprising a plurality of elongate heddles arranged in weftwise rows for guiding respective warp strands, warp strand supply means remote from said rows of heddles for directing warp strands thereto, means for longitudinally moving said heddles for forming the warp strands guided thereby into warp sheds, means for inserting wefts through warp sheds formed by the longitudinal movement of said heddles, means for shifting said heddles weftwise, and heddle transfer mechanism for engagingly receiving a heddle and for moving the same from one end of one row to the adjacent end of another row.

2. A weaving machine according to claim 1 wherein said heddle transfer mechanism effects movement of heddles in a predetermined path about an axis extending substantially perpendicular to the fell of the fabric being woven and lying in a plane between the rows of heddles.

3. A weaving machine according to claim 2 wherein said heddle transfer mechanism comprises a transfer arm mounted for movement on said axis and extending substantially radially therefrom, receptacle means connected to said transfer arm in spaced relation from said axis, and means drivingly connected to said transfer arm for moving the same about said axis and moving a heddle received in said receptacle means in said predetermined path.

4. A weaving machine according to claim 1 including means defining passageways for guiding each weftwise row of heddles during longitudinal movement thereof, said means for shifting said heddles weftwise being operable to shift said rows of heddles relative to said passageways, and said heddle transfer means engagingly receiving heddles from a leading end passageway at said one end of each row of heddles.

5. A weaving machine for making triaxial fabrics comprising a plurality of elongate heddles arranged in weftwise rows for guiding respective warp strands, warp strand supply means remote from said rows of heddles for directing warp strands thereto, means for longitudinally moving said heddles for forming the warp strands guided thereby into warp sheds, means for inserting wefts through warp sheds formed by the longitudinal movement of said heddles, means for shifting said heddles weftwise, and heddle transfer mechanism for engaging a heddle intermediate the length thereof and for moving the engaged heddle from one end of one row to the adjacent end of another row.

6. A weaving machine according to claim 5 wherein said heddle transfer means comprises heddle receptacle mechanism mounted for positioning in longitudinal alignment with an endmost heddle at said one end of one row for engagingly receiving the heddle upon longitudinal movement thereof in one direction, means for moving said heddle receptacle means with the heddle engaged thereby in a predetermined path from said one end of one row to the adjacent end of another row, and said heddle receptacle means being mounted for positioning in longitudinal alignment with a heddle receiving position at said adjacent end of another row for removal of the engaged heddle therefrom by a longitudinal movement of the heddle relative to the heddle receptacle means.

7. A weaving machine for making triaxial fabrics comprising a plurality of elongate heddles arranged in substantially opposing weftwise rows for guiding respective warp strands, means for longitudinally moving said heddles from and to retracted and extended open shed positions for forming the warp strands guided thereby into warp sheds, means for inserting wefts through warp sheds formed by the longitudinal movement of said heddles, means for shifting said rows of heddles weftwise, and heddle transfer means for engagingly receiving and moving a heddle from an extended position at one end of each row to a retracted position at the adjacent end of another substantially opposing row.

8. A weaving machine according to claim 7 wherein said heddle transfer means comprises receptacle means mounted adjacent the terminal ends of the rows of heddles and means for moving each receptacle means from a position adjacent one end of one row in a predetermined path about an axis extending substantially perpendicular to the fell of the fabric being woven and lying in a plane between the rows of heddles to another position adjacent the end of another row.

9. A weaving machine according to claim 8 wherein said means for moving each receptacle means in a predetermined path comprises means pivoted on said axis and supporting at least one of said receptacle means thereon, and means drivingly connected to said means pivoted on said axis for moving the same.

10. A weaving machine according to claim 7 including means defining weftwise rows of closely spaced passageways for guiding respective weftwise rows of heddles during the longitudinal movement thereof, said means for shifting said rows of heddles being operable to shift each of said rows of heddles relative to the respective row of passageways, and said heddle transfer means engagingly receiving a respective leading heddle from a leading end passageway at said one end of each row of heddles and for then moving the engaged heddle to said adjacent end of another row of heddles.

11. A weaving machine according to claim 7 wherein said heddle transfer means comprises heddle receptacle means mounted for positioning in longitudinal alignment with an endmost heddle at said one end of one row for engagingly receiving the heddle upon longitudinal movement thereof from a retracted position to said extended position, means for moving said heddle receptacle means with the heddle engaged thereby in a predetermined path from said one end of one row to the adjacent end of another row, and said heddle receptacle means being mounted for positioning in longitudinal alignment with a heddle receiving position at said adjacent end of another row for removal of the engaged heddle from said heddle receptacle means by longitudinal movement of the heddle from said retracted position to an extended position.

12. A weaving machine according to claim 7 wherein each of said heddles has a nose portion with a warp strand guide opening extending therethrough for threadingly receiving a respective warp strand and further wherein said heddle transfer means moves an engagingly received heddle from said one end of each row to said adjacent end of another row in a predetermined path and substantially pivotally about an axis extending through said nose portion of said engagingly received heddle, said axis extending substantially perpendicularly to the fell of the fabric being woven and lying on a plane between the opposing rows of heddles.

13. A weaving machine for making triaxial fabrics comprising a plurality of elongate heddles arranged in substantially opposing weftwise rows for guiding respective warp strands, means for longitudinally moving said heddles for forming the warp strands guided thereby into warp sheds, means for inserting wefts through warp sheds formed by the longitudinal movement of said heddles, heddle shifting means for shifting said heddles weftwise, means for engagingly receiving heddles at a first position one at a time in succession from one end of one of said rows of heddles, and means for moving said heddle receiving means with the heddle engaged thereby along a predetermined path extending about an axis lying in a plane between the rows of heddles and substantially perpendicular to the fell of fabric and to a second position adjacent another of said rows of heddles for thereby transferring successive heddles from one row to another row.

14. A weaving machine according to claim 13 wherein said means for moving said heddle receiving means along said predetermined path comprises a shaft mounted for rotation on said axis, a transfer arm extending substantially radially from said shaft and supporting said heddle receiving means in spaced relation from said axis, and means drivingly connected to said shaft for oscillating said transfer arm.

15. A weaving machine according to claim 13 wherein each of said heddles has a nose portion with a warp strand guide opening extending therethrough for threadingly receiving a respective warp strand and further wherein said means for moving said heddle receiving means with the heddle engaged thereby moves an engaged heddle from said one end of one row to an adjacent end of another row in said predetermined path and substantially pivotally about an axis extending through said nose portion of said engaged heddle and parallel to said axis about which said means for moving said heddle receiving means moves.

16. A weaving machine for making triaxial fabrics comprising a plurality of elongate heddles arranged in substantially opposing weftwise rows for guiding respective warp strands, means for longitudinally moving said heddles for forming the warp strands being guided thereby into warp sheds, weft inserting means for inserting wefts through warp sheds formed by the longitudinal movement of said heddles, means defining passageways for guiding each weftwise row of heddles during the longitudinal movement thereof, means for shifting said substantially opposing rows of heddles in opposite weftwise directions relative to each other and relative to said passageways, means for engagingly receiving a heddle at a first position from a leading end of one of said rows of heddles, and means for moving said heddle receiving means with the heddle engaged thereby along a predetermined path to a second position adjacent a trailing end of another of said rows of heddles for thereby transferring heddles from one row to another row.

17. A weaving machine according to claim 16 wherein said means for engagingly receiving a heddle is positioned in longitudinal alignment with a heddle to be transferred, with such heddle to be transferred then being in a retracted open shed position, and further wherein said means for longitudinally moving said heddles moves the heddle to be transferred from the retracted open shed position to an extended open shed position and into said means for engagingly receiving a heddle to be transferred.

18. A weaving machine for making triaxial fabrics comprising a plurality of elongate heddles arranged in a pair of substantially opposing weftwise rows for guiding respective warp strands, means for longitudinally moving said heddles for forming the warp strands guided thereby into warp sheds, means for inserting wefts through warp sheds formed by the longitudinal movement of said heddles, means defining passageways for guiding each weftwise row of heddles during the longitudinal movement thereof, means for shifting said rows of heddles in opposite weftwise directions relative to each other and relative to said passageways, said passageway defining means for each of said rows of heddles having a leading end with the endmost passageway thereof being cut away to expose each successive heddle as it reaches the same, means for engagingly receiving a thus exposed heddle from the leading endmost passageway of one of said pair of rows of heddles, and means for moving said heddle receiving means with the heddle engaged thereby along a predetermined path to a position adjacent a trailing endmost passageway of the other of said pair of rows of heddles for thereby transferring successive heddles from said one row to said other row.

19. A weaving machine according to claim 18 wherein said passageway defining means has a cutaway portion at the trailing endmost passageway of each of said rows of heddles and further wherein said heddle receiving means positions an engaged heddle in longitudinal alignment with the trailing endmost passageway of said other row.

20. A weaving machine for making triaxial fabrics comprising a plurality of elongate rows of heddles arranged in pairs of substantially opposing weftwise rows for guiding respective warp strands, warp strand supply means remote from said rows of heddles for directing warp strands thereto, means for longitudinally moving said heddles for forming the warp strands guided thereby into warp sheds, means for inserting wefts through warp sheds formed by the longitudinal movement of said heddles, means for shifting said rows of heddles weftwise, and heddle transfer mechanism for engagingly receiving and moving a heddle from one end of one of the rows in each pair of substantially opposing rows to the adjacent end of the other row in the same pair.

21. A weaving machine according to claim 20 wherein said transfer mechanism moves a heddle from said one end of one of the rows of each pair to the adjacent end of said other row in the same pair in a predetermined path about an axis extending substantially perpendicular to the fell of the fabric being woven and lying in a plane between the opposing rows of heddles.

22. A weaving machine according to claim 21 wherein said transfer mechanism comprises a pair of heddle receptacles, each for receiving heddles from a leading end of a corresponding one of the rows in a corresponding one of the pairs of rows, a transfer arm mounted for movement about said axis and extending substantially radially therefrom, means mounting said pair of heddle receptacles on said transfer arm in spaced relation from said axis, and means drivingly connected to said transfer arm for moving the same.

23. A weaving machine for making triaxial fabrics comprising a plurality of elongate rows of heddles arranged in pairs of substantially opposing weftwise rows for guiding respective warp strands, warp strand supply means remote from said rows of heddles for directing warp strands thereto, means for moving said heddles longitudinally for forming the warp strands guided thereby into warp sheds, means for inserting wefts through warp sheds formed by the longitudinal movement of said heddles, means for shifting said rows of heddles weftwise, and mechanism for engagingly receiving and moving successive heddles one at a time from one end of one of the rows in each pair of substantially opposing rows to the adjacent end of the other row in the same pair.

24. In a method of making triaxial fabrics in which a plurality of warp strands are guidingly received in warp strand guide openings extending through nose portions of elongate heddles arranged in substantially opposing rows, formed into warp sheds by longitudinal movement of the heddles and moved weftwise by shifting of the heddles, the improvement comprising transferring heddles from one end of one weftwise row to an adjacent end of an opposing weftwise row by pivoting each heddle about an axis which extends substantially through the nose portion thereof while moving the heddle in a plane substantially parallel to the fell of the fabric being made.

25. A method according to claim 24 wherein each heddle being transferred is pivoted about an axis extending generally in the direction of the warp strands.

26. A method according to claim 25 wherein each heddle being transferred is moved in a horizontal plane.

27. A method according to claim 24 wherein the heddles being transferred are pivoted about an axis perpendicular both to the heddles and to the fell of the fabric being made.

28. In a method of making triaxial fabric in which a plurality of warp strands are guidingly received in warp strand guide openings extending through nose portions of elongate heddles arranged in substantially opposing weftwise rows, formed into warp sheds by longitudinal movement of the rows of heddles to and from first and second open shed positions and moved weftwise by shifting of the heddles, the improvement comprising transferring heddles from one end of one weftwise row to an adjacent end of an opposing weftwise row while moving the heddles being transferred from one of the open shed positions at the end of the one weftwise row to the other of the open shed positions at the adjacent end of the opposing weftwise row.

29. In a method of making triaxial fabric in which a plurality of warp strands are guidingly received in warp strand guide openings extending through nose portions of elongate heddles arranged in substantially opposing weftwise rows, formed into warp sheds by longitudinal movement of the heddles between extended and retracted open shed positions and moved weftwise by shifting of the heddles, the improvement comprising transferring heddles from one end of one weftwise row to an adjacent end of an opposing weftwise row while moving the heddles being transferred from the extended open shed position at the end of the one weftwise row to the retracted open shed position at the adjacent end of the opposing weftwise row.

30. In a method of making triaxial fabric in which a plurality of warp strands extending from a remote warp strand supply are guidingly received in warp strand guide openings extending through nose portions of elongate heddles arranged in substantially opposing weftwise rows, formed into warp sheds by longitudinal movement of the heddles and moved weftwise by shifting of the heddles, the improvement comprising transferring heddles from one end of one weftwise row to an adjacent end of another opposing weftwise row while moving the heddles in such a path that those portions of the respective warp strands extending between the heddles and the fell of the fabric being made remains in substantial alignment with the selvage of the fabric to avoid deflection of the warp strands outwardly beyond the selvage thereby facilitating the transfer operation.

31. In a method of making triaxial fabric in which a plurality of warp strands extending from a remote warp strand supply are guidingly received in warp strand guide openings extending through nose portions of elongate heddles arranged in substantially opposing weftwise rows, formed into warp sheds by longitudinal movement of the heddles and moved weftwise by shifting of the heddles, the improvement comprising transferring heddles from one end of one weftwise row to an adjacent end of another opposing weftwise row while maintaining respective warp strands substantially in the same position to avoid weftwise shifting thereof thereby facilitating the transfer operation.

* * * * *

UNITED STATES PATENT AND TRADEMARK OFFICE

CERTIFICATE OF CORRECTION

PATENT NO. : 4,013,103

DATED : March 22, 1977

INVENTOR(S) : Karol Kulczycki et al.

It is certified that error appears in the above-identified patent and that said Letters Patent are hereby corrected as shown below:

Column 13, Line 63 "means" should be - mechanism -;
Column 14, Line 12 "means" should be - mechanism -;
Column 14, Line 13 "mechanism" should be - means -.

Signed and Sealed this

*fifth* Day of *July 1977*

[SEAL]

*Attest:*

RUTH C. MASON
*Attesting Officer*

C. MARSHALL DANN
*Commissioner of Patents and Trademarks*